United States Patent [19]

Holoubek

[11] 4,333,573

[45] Jun. 8, 1982

[54] STACKABLE TRAY

[76] Inventor: Verne R. Holoubek, Branch Road Farm, Ixonia, Wis. 53036

[21] Appl. No.: 152,560

[22] Filed: May 23, 1980

[51] Int. Cl.[3] ..... B42F 17/12

[52] U.S. Cl. ..... 211/11; 211/126; 211/128; 220/22; 248/DIG. 9; 312/183

[58] Field of Search ..... 211/11, 126, 128; 248/DIG. 9; 312/183; 220/20, 22; 52/98

[56] References Cited

U.S. PATENT DOCUMENTS

| | | | |
|---|---|---|---|
| 3,154,197 | 10/1964 | Tweed | 211/126 |
| 3,480,150 | 11/1969 | Cornell et al. | 211/11 |
| 3,524,553 | 8/1970 | Zitmore | 211/128 |
| 3,533,512 | 10/1970 | Serwer | 211/126 |
| 3,549,018 | 11/1970 | Wilson | 211/126 |
| 3,703,955 | 11/1972 | Inacker | 220/20 X |
| 3,750,892 | 8/1973 | Greese | 211/128 |
| 3,780,905 | 12/1973 | Herolzer | 211/126 X |
| 3,874,510 | 4/1975 | Perry et al. | 211/126 |
| 4,084,695 | 4/1978 | Halbich | 220/22 |

FOREIGN PATENT DOCUMENTS

| | | | |
|---|---|---|---|
| 873707 | 6/1971 | Canada | 211/126 |

*Primary Examiner*—Ernest R. Purser

*Attorney, Agent, or Firm*—Andrus, Sceales, Starke & Sawall

[57] ABSTRACT

A stackable tray (11) functions with an adjacent stacked tray (12) to form a substantial enclosure (32) about an upper tray surface (15) formed by the tray sidewalls (17, 18) and tray endwall (21) and the lower surface (16') of an adjacently stacked tray (12). A break away separator (38) divides the enclosure (32) storage area into separate storage channels (40, 41) but may be broken away to form a larger channel area. Removable dividers (36) are selectively positioned in one of a plurality of spaced grooves (35) formed in the upper tray surface (15) to limit the depth of entry of stored items (34) into the substantial enclosure (32). Notches (28) and complimentary tabs (29) formed in lips (26) and grooves (27) of the sidewalls (17, 18) function to prevent sliding movement between adjacently stacked trays.

3 Claims, 6 Drawing Figures

STACKABLE TRAY

BACKGROUND OF THE INVENTION

The invention relates to a stackable tray for the storage of items.

A wide variety of desk and letter trays have been utilized for a wide variety of purposes such as holding letters, files, sheet-like papers, and many other assorted items. Further, such trays have been used to store larger objects to be later removed for usage when desired.

Frequently, such trays have been vertically stacked and are commonly found in offices as "IN" and "OUT" baskets or otherwise used for a great many purposes.

BRIEF SUMMARY OF THE INVENTION

A stackable tray employs a breakaway separator used to vary the storage size of a storage channel therein for adaptation to the relative size of the stored item.

The stackable tray includes a base having an upper surface to support a stored item and a spaced lower surface. A pair of sidewalls and an end wall are connected to the base and include means to support another stacked tray to form a substantial enclosure about the upper base surface formed by the sidewalls and the end wall of one tray and the lower surface of an adjacent stacked tray. Access to the substantial enclosure is provided at a base front portion which is oppositely spaced from the rear end wall. The separator is interconnected to the base upper surface to project into the substantial enclosure to form a plurality of channels within the substantial enclosure. In use, the separator may remain intact to provide plural channels each having a predetermined area to store items therein or may be broken away from the upper surface and totally removed from the tray to enlarge one of the channels to a larger size to store a larger sized item.

Each of the walls includes a lower lip adjacent to the lower surface and a recessed groove spaced from the supporting surface which functions to removably support the lower lip of another stacked tray. The lower lip provides a notch which releasably mates with a tab formed within the upper groove of another tray to prevent sliding movement between adjacent trays when stacked.

The invention provides a highly desirable tray which may be easily stacked to provide a large number of vertically spaced trays which are extremely stable and secure. The invention permits a preselected adjustment of both the length and width of one or more storage channels provided by each tray to match the size of items to be stored therein.

DESCRIPTION OF THE PREFERRED EMBODIMENT

Figure 1:
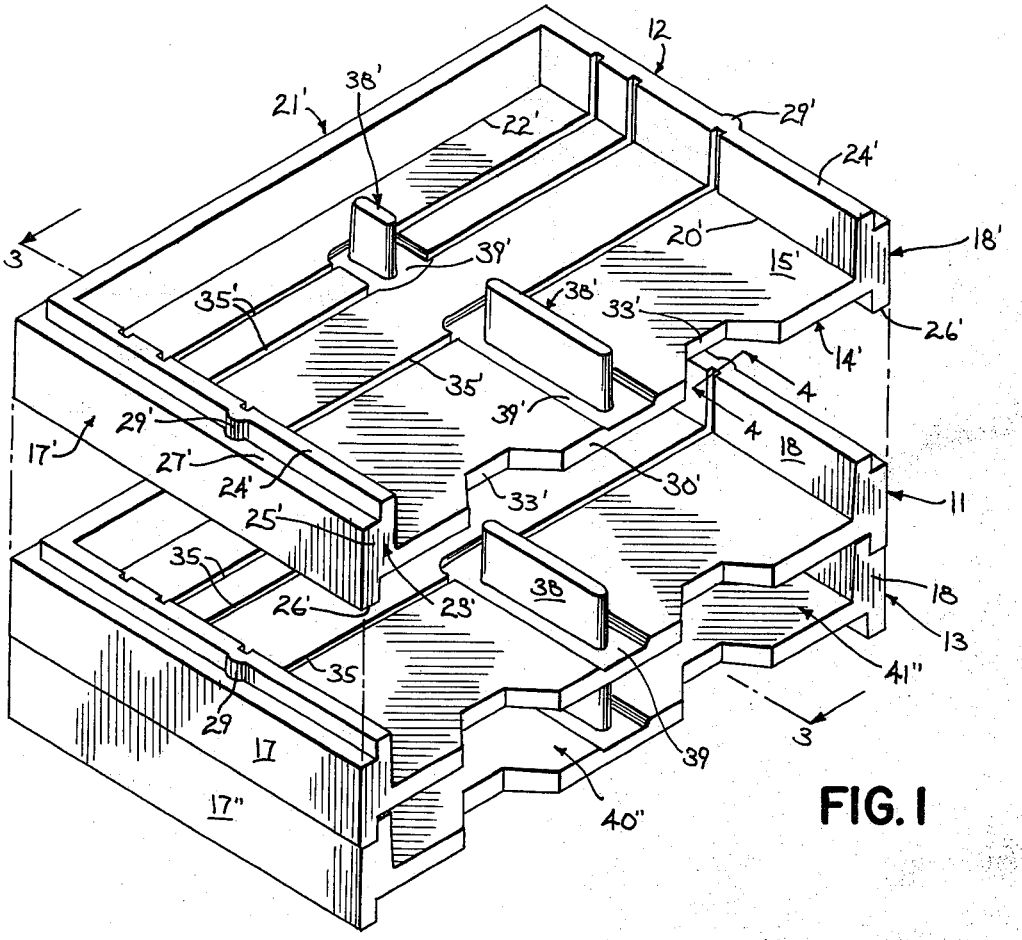
FIG. 1 is a prospective view showing a series of stackable trays of the invention.

A stackable tray 11 is constructed to be stacked between adjacent similarly constructed stackable trays 12 and 13.

In that trays 11, 12 and 13 are identically constructed, the specific elements of tray 11 will be described in detail and it is understood that identical elements of tray 12 will be identified by identical numbers primed while identical elements of tray 13 will be identified by identical numbers double primed.

The stackable tray 11 includes a substantially rectangular base 14 having an upper surface 15 and an oppositely spaced lower surface 16.

A pair of spaced, substantially parallel sidewalls 17 and 18 are connected to side edges 19 and 20, respectively, of base 14. An end wall 21 is connected to an end edge 22 of the base 14 and connects the sidewalls 17 and 18.

Each of the walls 17, 18 and 21 includes an inner portion 23 which extends along the base 14 and is constructed to be substantially normal to the upper surface 15 and provides an upper lip 24. An outer portion 25 of walls 17, 18 and 21 likewise extends along the base 14 and is substantially normal to the lower surface 16. The outer portion 25 includes a lower lip 26 which is located within a vertical plane spaced from a vertical plane containing the upper lip 24. The outer portion 25 also forms a recessed groove 27 which is adjacent to the upper lip 24 and functions to removably support the lower lip 26' of the stacked tray 12.

Each of the sidewalls 17 and 18 includes a notch 28 within the lower lip 26 which releasably mates with a tab 29'' formed within the recessed groove 27'' of tray 13 to prevent sliding movement between trays 11 and 13 when stacked.

The base 14 provides a front edge 30 which is spaced from the end edge 22 to form an access opening 31 to the upper base surface 15. A substantial enclosure 32 is thus formed about the upper surface 15 by the spaced sidewalls 17 and 18 and the endwall 21 of tray 11 and the lower surface 16' of the adjacently stacked tray 12 with access to the substantial enclosure 32 provided through opening 31 adjacent to the front base edge 30.

The base front edge 30 includes a pair of spaced indentations 33 which permit the manual grasping of items such as illustrated at 34 located within the substantial enclosure 32.

Figure 3:
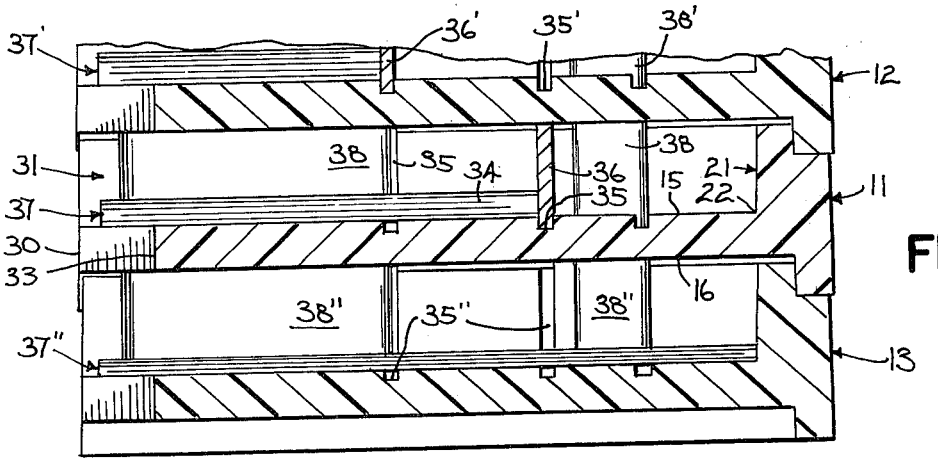
FIG. 3 is a sectional view taken along the line 3—3 in FIG. 1 and illustrating the storage of items in all three trays with removable dividing panels utilized within the upper two trays.
Figure 4:
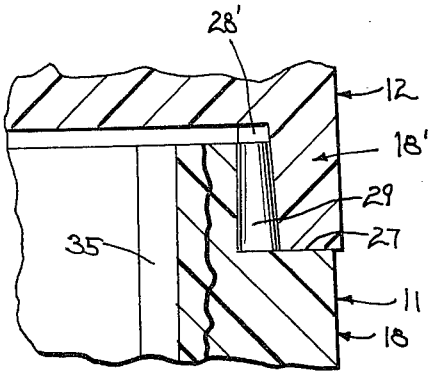
FIG. 4 is a partial sectioned view taken along the line 4—4 in FIG. 1 and illustrating the interconnection of a tab of one tray with a notch of another tray to prevent sliding movement between adjacent trays when stacked.
Figure 5:
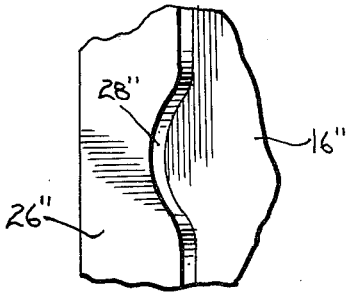
FIG. 5 is a partial sectioned view taken along the line 5—5 in FIG. 2 and showing the notch as illustrated in FIG. 4.

The upper surface 15 of base 14 includes a plurality of spaced, substantially parallel grooves 35 each located between the spaced sidewalls 17 and 18 and, in fact, continue as vertical grooves along the sidewalls 17 and 18. Such grooves 35 releasably retain one or more removable dividing panels 36, as illustrated in FIG. 3. Each panel is formed to snuggly seat within a particular groove 35 and extends upwardly into the substantial enclosure 32 toward the lower base surface 16' of tray 12. Each dividing panel 36 functions to limit the depth of entry of the items, such as the sheets 34 illustrated in FIG. 3, into the substantial enclosure 32. In such manner, the forward or leading edges 37 of items 34 are maintained immediately adjacent to the base front edge 30 and particularly in overlapping relationship with the indentations 33. Such construction permits the easy grasping of items 34 at one of the indentations 33 for easy removal of the items from the enclosure 32.

Each dividing panel 35 may readily be disconnected from a given groove 35 and repositioned in an adjacent groove to vary the depth of entry into the substantial enclosure 32. In such manner, the depth of entry for the stored items may be easily varied according to their relative size to maintain their leading edge 37 in close proximate relationship to the indentations 33.

Figure 6:
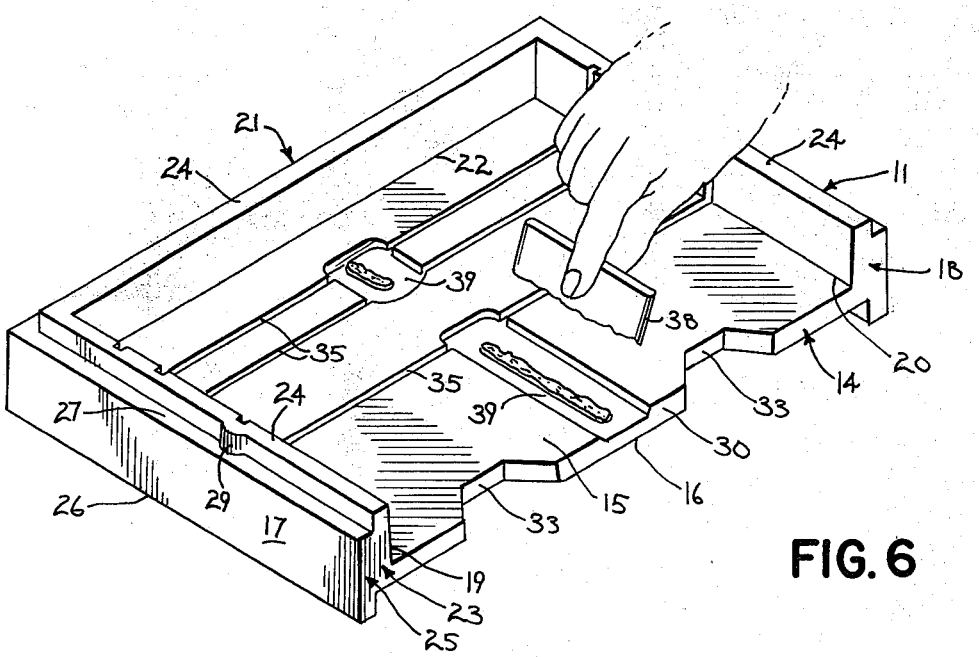
FIG. 6 is a prospective view of one of the trays of FIG. 1 and illustrating the manual removal of the separators to enlarge the storage retaining area of the tray.
Figure 2:
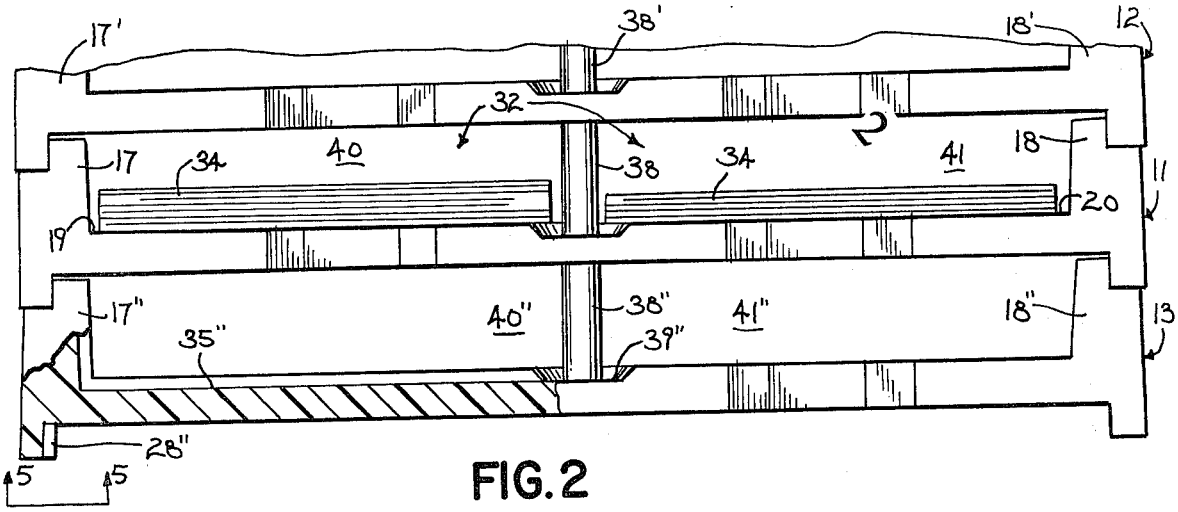
FIG. 2 is a front elevational view of the trays of FIG. 1 with parts broken away and showing the storage of items in the intermediate tray.

A plurality of spaced separators 38 are integrally connected to an associated groove 39 formed within the upper surface 15 of base 14. The separators 38 extend upwardly into the substantial enclosure area 32 and, if desired, may engage the lower surface 16' of tray 12. In any event, the separators 38 form a plurality of channels 40 and 41 within the substantial enclosure 32 with each channel being substantially parallel to the sidewalls 17 and 18. Each of the separators 38 is formed of a rigid but brittle material which is adapted to readily snap away from the upper surface 15 of base 14, as illustrated in FIG. 6. In such manner, the separators 38 are readily manually removed from tray 11 to thereby enlarge the storage channel for holding larger items which would not otherwise fit within the smaller channels 40 and 41 formed when separator 38 is connected to tray 11.

The substantially enclosed storage area for any given item 34 may be readily adapted according to the relative size of such item to facilitate the easy insertion and removal of such item from the substantial enclosure area. The invention provides a unique construction and operation whereby the storage channels and areas for retaining stored items can be selectively varied to provide larger channels and areas or smaller channels and areas to provide a corresponding fit for the particular size of items to be stored.

The invention provides a simple and economical construction which may be readily fabricated and economically marketed for a large variety of uses.

Various modes for carrying out the invention are contemplated as being within the scope of the following claims particularly pointing out and distinctly claiming the subject matter which is regarded as the invention.

I claim:

1. A stackable tray for the storage of an item, comprising a base having an upper surface to support said item and a spaced lower surface, a pair of side walls and an end wall connected to said base and including means to support another stacked tray to form a substantial enclosure about said upper surface by said side walls and said end wall of one tray and the lower surface of an adjacent stacked tray with access to said substantial enclosure provided at a base front portion oppositely spaced from said end wall, and a plurality of spaced separators integrally connected to said upper surface to project into said substantial enclosure to form a plurality of channels within said substantial enclosure, said separators adapted to be selectively broken away from said upper surface and to be removed therefrom to selectively enlarge one of the channels and to selectively limit the depth of entry of an item into the enlarged channel as desired for providing substantially enclosed storage adaptable to the relative length and width of the stored item.

2. The tray of claim 1, wherein said supporting means includes a lower lip spaced adjacent to said lower surface and a recessed upper groove spaced from said supporting surface with said groove removably supporting the lower lip of another stacked tray, said lower lip providing a notch for releasably mating with a tab within said upper groove of another tray to prevent sliding movement between adjacent trays when stacked.

3. A stackable tray for the storage of an item, comprising in combination a substantially rectangular base having an upper surface to support said items and a spaced lower surface, a pair of spaced, substantially parallel side walls connected to respective side edges of said base and an end wall connected to an end edge of said base to connect said side walls, with each of said walls including an inner portion extending along said base and substantially normal from said upper surface to provide an upper lip and an outer portion extending along said base and substantially normal from said lower surface to provide a lower lip within a plane spaced from the plane containing said upper lip and to provide a recessed groove adjacent said upper lip to removably support the lower lip of another stacked tray, each of said side walls having a notch within said lower lip for releasably mating with a tab within said recessed groove of another tray to prevent sliding movement between adjacent trays when stacked, said base having a front edge spaced from said end edge to form an access opening to said upper base surface so that a substantial enclosure is formed about said upper surface by said spaced side walls and said end wall of one tray and the lower surface of an adjacent stacked tray with access to said substantial enclosure provided at said base front edge, said base front edge providing a plurality of indentations to permit the manual grasping of an item located within said substantial enclosure, said base upper surface including a plurality of spaced, substantially parallel grooves each located between said spaced side walls to releasably retain a removable dividing panel extending from said groove toward the base lower surface of an adjacent stacked tray to limit the depth of entry of an item into said substantial enclosure to maintain said item immediately adjacent said base front edge to permit easy grasping thereof at one of said plurality of indentations, and a plurality of spaced separators integrally connected to an associated groove formed within said base upper surface to releasably engage the lower surface of another stacked tray to form a plurality of channels within said substantial enclosure which are substantially parallel with said side walls, said separators adapted to snap away from said base upper surface to be removed therefrom to selectively enlarge one of the channels as desired for providing substantially enclosed storage adaptable to the relative size of the stored item for the easy insertion and removal of an item from the substantial enclosure.

* * * * *